US011739935B1

(12) United States Patent
Kahn et al.

(10) Patent No.: US 11,739,935 B1
(45) Date of Patent: Aug. 29, 2023

(54) DOME STRUCTURE PROVIDING A DOME-DEFLECTOR CAVITY WITH COUNTER-SWIRLED AIRFLOW

(71) Applicant: General Electric Company, Schenectady, NY (US)

(72) Inventors: Adam Kahn, Mason, OH (US); Nayan Patel, Liberty Township, OH (US); Dhanashegaran Shanmugam, Mason, OH (US); Anil Raju, Mason, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 17/656,123

(22) Filed: Mar. 23, 2022

(51) Int. Cl.

| | |
|---|---|
| ***F23R 3/04*** | (2006.01) |
| ***F23R 3/12*** | (2006.01) |
| ***F23R 3/28*** | (2006.01) |
| ***F23R 3/14*** | (2006.01) |

(52) U.S. Cl.
CPC ..... *F23R 3/12* (2013.01); *F23R 3/04* (2013.01); *F23R 3/14* (2013.01); *F23R 3/283* (2013.01); *F23R 2900/03041* (2013.01); *F23R 2900/03042* (2013.01)

(58) Field of Classification Search
CPC ..... F23R 3/04; F23R 3/10; F23R 3/12; F23R 2900/03041; F23R 2900/03042; F23R 3/14; F23R 3/283; F23R 3/286
See application file for complete search history.

(56) References Cited

U.S. PATENT DOCUMENTS

| | | | | | |
|---|---|---|---|---|---|
| 4,241,586 | A | * | 12/1980 | Caruel | F23R 3/002 60/738 |
| 5,012,645 | A | * | 5/1991 | Reynolds | F23R 3/10 60/754 |
| 5,129,231 | A | * | 7/1992 | Becker | F23R 3/14 60/754 |
| 5,271,219 | A | * | 12/1993 | Richardson | F23R 3/10 60/804 |
| 5,319,935 | A | | 6/1994 | Toon et al. | |
| 5,623,827 | A | * | 4/1997 | Monty | F23R 3/10 60/804 |
| 5,918,467 | A | * | 7/1999 | Kwan | F23R 3/10 60/754 |

(Continued)

FOREIGN PATENT DOCUMENTS

| | | | |
|---|---|---|---|
| EP | 1510759 | A1 | 3/2005 |
| EP | 2384392 | B1 | 5/2017 |

(Continued)

*Primary Examiner* — William H Rodriguez
(74) *Attorney, Agent, or Firm* — Venable LLP; Edward A. Kmett; Michele V. Frank

(57) ABSTRACT

A dome-deflector structure for a combustor of a gas turbine includes a dome portion and a deflector portion, the dome portion and the deflector portion being connected together to form a dome-deflector cavity therebetween. The dome portion includes a plurality of dome-side cooling airflow passages therethrough arranged in a plurality of groups of dome-side cooling airflow passages, each group of dome-side cooling airflow passages being arranged to provide a flow of air therethrough in a respective group swirl direction, and adjacent groups of the dome-side cooling airflow passages providing the flow of air in a different group swirl direction with respect to one another.

20 Claims, 7 Drawing Sheets

(56) References Cited

U.S. PATENT DOCUMENTS

| | | | | |
|---|---|---|---|---|
| 5,941,076 | A * | 8/1999 | Sandelis | F23R 3/10 60/754 |
| 5,956,955 | A * | 9/1999 | Schmid | F23R 3/10 60/804 |
| 7,089,741 | B2 | 8/2006 | Ikeda et al. | |
| 9,506,652 | B2 | 11/2016 | Carrere et al. | |
| 10,488,046 | B2 | 11/2019 | Low et al. | |
| 10,760,792 | B2 | 9/2020 | Patel et al. | |
| 10,823,416 | B2 | 11/2020 | Patel et al. | |
| 10,837,640 | B2 | 11/2020 | Patel et al. | |
| 10,844,791 | B2 | 11/2020 | Olsen et al. | |
| 11,187,412 | B2 * | 11/2021 | Bilse | F23R 3/10 |
| 2006/0272335 | A1 * | 12/2006 | Schumacher | F23R 3/12 60/752 |
| 2013/0078582 | A1 * | 3/2013 | Pidcock | F23R 3/06 431/12 |
| 2016/0010862 | A1 * | 1/2016 | Balan | F23R 3/002 60/753 |
| 2019/0093892 | A1 * | 3/2019 | Rimmer | F23R 3/10 |
| 2020/0025384 | A1 * | 1/2020 | Patel | F23R 3/002 |
| 2020/0063963 | A1 * | 2/2020 | Bilse | F23R 3/10 |

FOREIGN PATENT DOCUMENTS

| | | | |
|---|---|---|---|
| EP | 3431875 | B1 | 12/2020 |
| WO | 2015023764 | A1 | 2/2015 |

* cited by examiner

DOME STRUCTURE PROVIDING A DOME-DEFLECTOR CAVITY WITH COUNTER-SWIRLED AIRFLOW

TECHNICAL FIELD

The present disclosure relates to a dome-deflector structure for a combustor of a gas turbine engine.

BACKGROUND

Gas turbine engines are known to include a combustor that has a dome structure extending around the combustor. The dome structure, that may include a dome and a deflector, generally provides separation between an air plenum upstream of the dome structure, and a combustion chamber downstream of the dome structure. A plurality of mixer assemblies are included in the combustor, and each mixer assembly extends through the dome structure to provide a fuel-air mixture into a combustion chamber adjacent to the dome structure. To provide protection from heat during combustion, the deflector may be provided on the combustion chamber side of the dome structure to protect the mixer assembly and the dome from the heat generated during combustion of the fuel-air mixture in the combustion chamber. The dome structure may include a cavity between the dome and the deflector to provide impingement cooling to the deflector.

BRIEF DESCRIPTION OF THE DRAWINGS

Features and advantages of the present disclosure will be apparent from the following description of various exemplary embodiments, as illustrated in the accompanying drawings, wherein like reference numbers generally indicate identical, functionally similar, and/or structurally similar elements.

DETAILED DESCRIPTION

Figure 1:
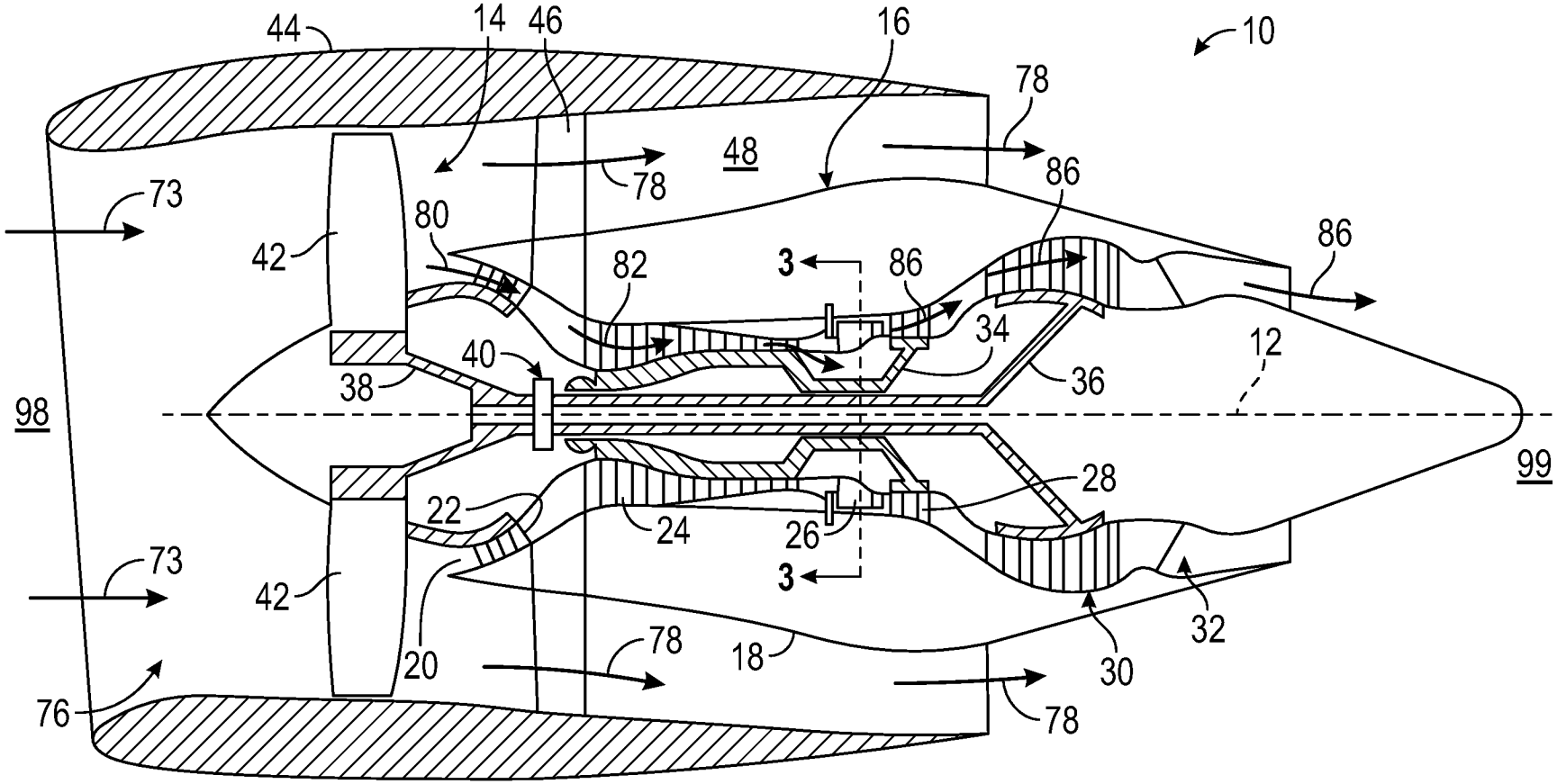
FIG. 1 is a schematic partial cross-sectional side view of an exemplary high by-pass turbofan jet engine, according to an aspect of the present disclosure.

Features, advantages, and embodiments of the present disclosure are set forth, or apparent from, a consideration of the following detailed description, drawings, and claims.

Moreover, it is to be understood that the following detailed description is exemplary and intended to provide further explanation without limiting the scope of the disclosure as claimed.

Various embodiments are discussed in detail below. While specific embodiments are discussed, this is done for illustration purposes only. A person skilled in the relevant art will recognize that other components and configurations may be used without departing from the spirit and the scope of the present disclosure.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

Gas turbine engines are known to include a combustor that has a dome structure extending around the combustor. The dome structure, which may include a dome and a deflector connected together, generally provides separation between an air plenum upstream of the dome structure, and a combustion chamber downstream of the dome structure. The deflector may be provided on the combustion chamber side of the dome structure and a cavity may be provided between the dome and the deflector to provide impingement cooling to the deflector. The dome may include airflow passages therethrough that are arranged to provide a flow of the air within the cavity in a bulk swirl about the cavity. The deflector may include airflow passages to provide a flow of air from the cavity to the combustion chamber side of the deflector. The bulk swirl within the cavity reduces the feed pressure from the cavity to the air provided through the deflector airflow passages. In addition, the air provided to the cavity is air that has been ingested to a compressor of the gas turbine and then provided to the combustor from the compressor. In certain operating conditions, such as ground operations in areas containing a high amount of dust or dirt particulates in the air, the particulates can flow through the compressor and into the combustor. The particulates in the air may then be provided through the dome cooling passages into the cavity, causing a build-up of the particulates within the cavity. The particulate build-up within the cavity reduces the efficiency of the impingement cooling to the deflector, including potential restriction of the airflow through the dome cooling passages. The particulate build-up can also lead to restriction of the airflow through the deflector cooling passages, thereby reducing the film cooling efficiency on the combustion side of the deflector. The reduced cooling efficiency of the deflector leads to a reduction in the life of the deflector, thereby requiring more frequent replacement.

The present disclosure addresses the foregoing by providing a dome structure having cooling passages arranged in the dome to provide improved circulation of the airflow within the dome-deflector cavity. According to an aspect of the present disclosure, a dome-deflector structure includes a dome portion and a deflector portion connected together to form a dome-deflector cavity therebetween. The dome portion includes a plurality of dome-side cooling airflow passages therethrough arranged in a plurality of groups of dome-side cooling airflow passages. Each group of dome-side cooling airflow passages is arranged to provide a flow of air therethrough in a respective group swirl direction, and adjacent groups of the dome-side cooling airflow passages providing the flow of air in a different group swirl direction with respect to one another. Thus, the arrangement of the cooling airflow passages through the dome can provide for opposing flows of the air into the cavity in different swirl directions, thereby reducing the impact that the bulk swirl arrangement has on reducing the feed pressure to the airflow passages through the deflector. In addition, the arrangement of the cooling passages through the dome generates greater mixing and turbulence of the airflow within the dome-deflector cavity to reduce dust and dirt build-up that may otherwise occur.

Referring now to the drawings, FIG. 1 is a schematic partial cross-sectional side view of an exemplary high by-pass turbofan jet engine 10, herein referred to as "engine 10," as may incorporate various embodiments of the present disclosure. Although further described below with reference to a ducted turbofan engine, the present disclosure is also applicable to turbomachinery in general, including turbojet, turboprop, and turboshaft gas turbine engines, including marine turbine engines, industrial turbine engines, and auxiliary power units. In addition, the present disclosure is not limited to ducted fan type turbine engines, such as that shown in FIG. 1, but, can be implemented in unducted fan (UDF) type turbine engines. As shown in FIG. 1, engine 10 has an axial centerline axis 12 that extends therethrough from an upstream end 98 to a downstream end 99 for reference purposes. In general, engine 10 may include a fan assembly 14 and a core engine 16 disposed downstream from the fan assembly 14.

The core engine 16 may generally include an outer casing 18 that defines an annular inlet 20. The outer casing 18 encases, or at least partially forms, in serial flow relationship, a compressor section (22/24) having a low pressure (LP) compressor 22, a high pressure (HP) compressor 24, a combustor 26, a turbine section (28/30) including a high pressure (HP) turbine 28 and a low pressure (LP) turbine 30, and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40, such as in an indirect-drive or a geared-drive configuration.

As shown in FIG. 1, the fan assembly 14 includes a plurality of fan blades 42 that are coupled to, and extend radially outwardly from, the fan shaft 38. An annular fan casing or nacelle 44 circumferentially surrounds the fan assembly 14 and/or at least a portion of the core engine 16. In one embodiment, the nacelle 44 may be supported relative to the core engine 16 by a plurality of circumferentially spaced outlet guide vanes or struts 46. Moreover, at least a portion of the nacelle 44 may extend over an outer portion of the core engine 16 so as to define a bypass airflow passage 48 therebetween.

Figure 2:
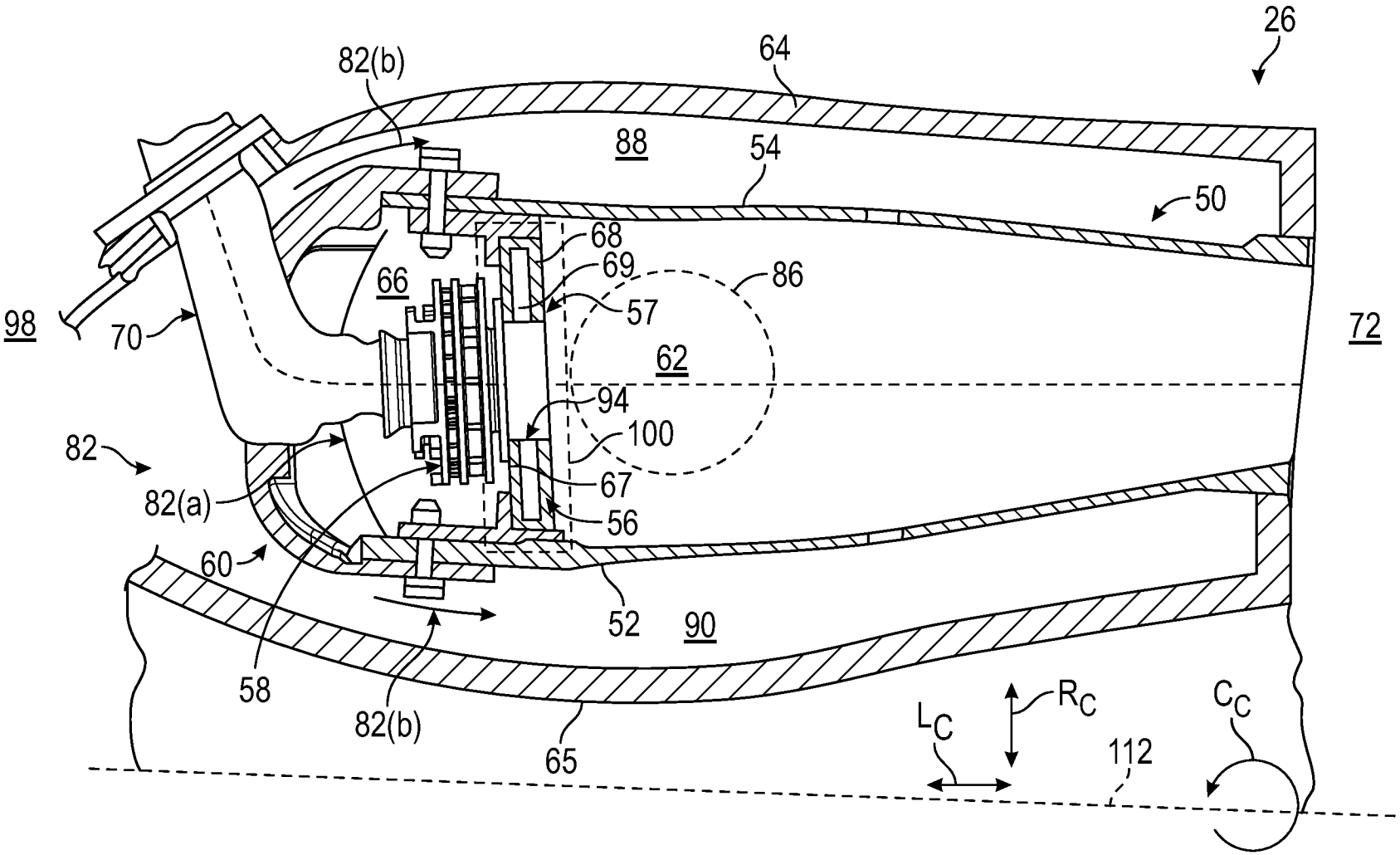
FIG. 2 is a partial cross-sectional side view of an exemplary combustor, according to an aspect of the present disclosure.

FIG. 2 is a cross-sectional side view of an exemplary combustor 26 of the core engine 16 as shown in FIG. 1. FIG. 2 depicts a combustor axial centerline 112 that may generally correspond to the engine axial centerline axis 12. Thus, the combustor 26 of FIG. 2 defines a combustor longitudinal direction ($L_C$) corresponding to the combustor axial centerline 112, a combustor radial direction ($R_C$) extending outward from the combustor axial centerline 112, and a combustor circumferential direction ($C_C$) extending circumferentially about the combustor axial centerline 112. As shown in FIG. 2, the combustor 26 may generally include a combustor liner 50, having an inner liner 52 and an outer liner 54 that are connected to a cowl 60. Each of the inner liner 52 and the outer liner 54 is an annular liner that extends circumferentially about the combustor axial centerline 112. A dome 56 is connected to the cowl 60, and extends in the combustor radial direction $R_C$ between the inner liner 52 and the outer liner 54, and also extends circumferentially about the combustor axial centerline 112. The dome 56 includes a plurality of dome-deflector structures 57 (to be described in more detail below) that include a dome portion 67, a deflector portion 68, and a dome-deflector cavity 69 defined between the dome portion 67 and the deflector portion 68. Together, the inner liner 52, the outer liner 54, and the dome 56 define a combustion chamber 62 therebetween. In the combustion chamber 62, an initial chemical reaction of an ignited fuel-oxidizer mixture injected into the combustion chamber 62 by a swirler assembly 58 may occur to generate combustion gases 86. The combustion gases 86 then flow further downstream into the HP turbine 28 and the LP turbine 30 (FIG. 1) via a turbine nozzle 72 at a downstream end of the combustion chamber 62. While FIG. 2 depicts a single swirler assembly 58, a plurality of the swirler assemblies 58 are present in the combustor 26, where the respective swirler assemblies 58 are circumferentially spaced apart from one another about the combustor axial centerline 112.

The combustor 26 further includes an outer casing 64 that extends circumferentially about the combustor axial centerline 112, and an inner casing 65 that also extends circumferentially about the combustor axial centerline 112. An outer flow passage 88 is defined between the outer casing 64 and the outer liner 54, and an inner flow passage 90 is defined between the inner casing 65 and the inner liner 52.

Referring back to FIG. 1, in operation, air 73 enters the nacelle 44 at a nacelle inlet 76, and a portion of the air 73 enters the compressor section (22/24) as a compressor inlet air flow 80, where it is compressed to form compressed air 82. Another portion of the air 73 enters the bypass airflow passage 48, thereby providing a bypass airflow 78. In FIG. 2, the compressed air 82 from the compressor section (22/24) enters the combustor 26 via a diffuser (not shown). A portion of the compressed air 82, shown schematically as compressed air 82(*a*) enters the cowl 60 into a pressure plenum 66 therewithin, while another portion of the compressed air 82, shown schematically as compressed air 82(*b*), passes to the outer flow passage 88 and to the inner flow passage 90. The compressed air 82(*a*) in the pressure plenum 66 passes through the swirler assembly 58 to mix with fuel injected by a fuel nozzle assembly 70 to form a fuel-oxidizer mixture (not shown) that is then ignited and burned in the combustion chamber 62 to generate the combustion gases 86.

Figure 3:
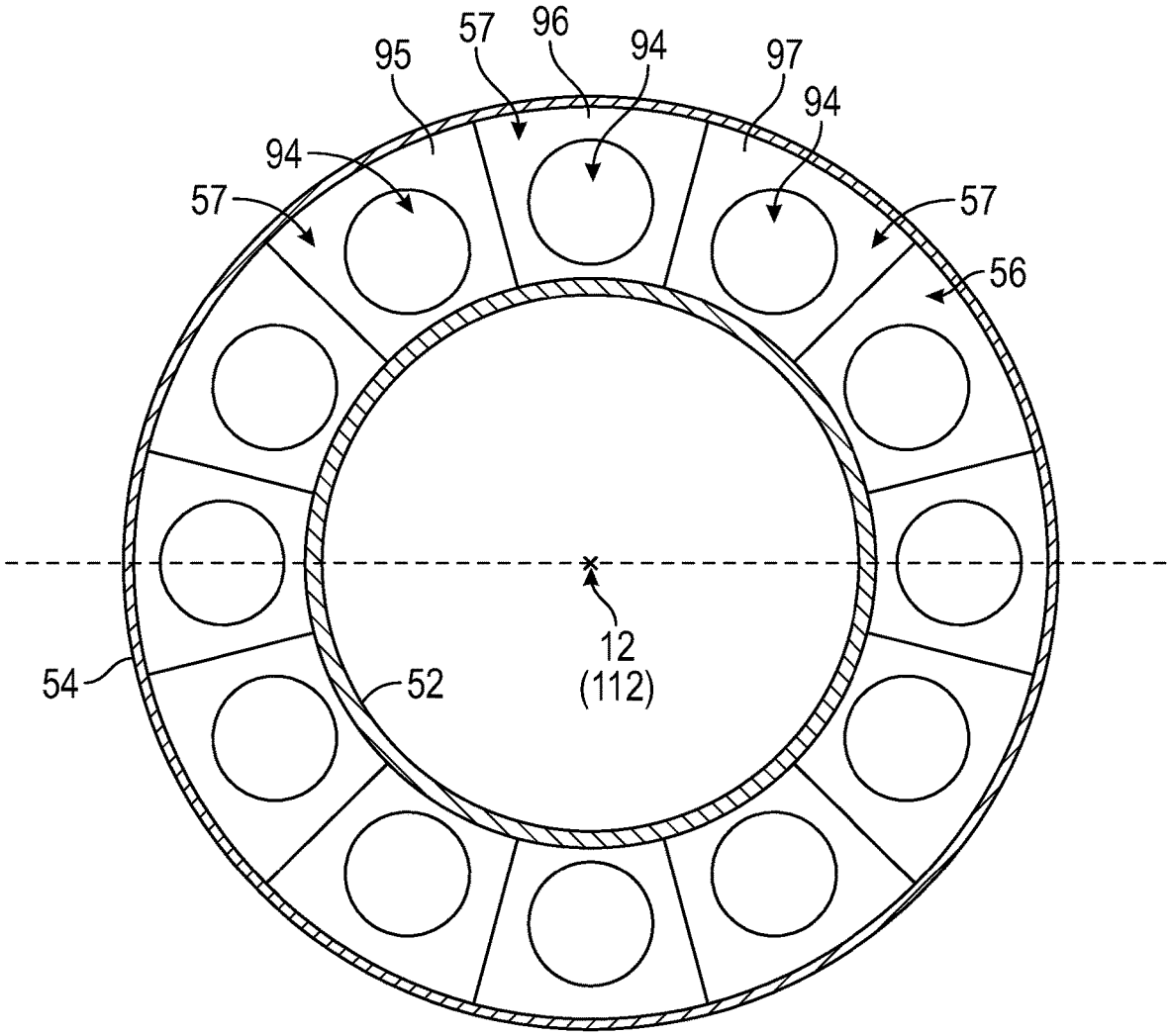
FIG. 3 depicts an aft forward-looking view of a dome-deflector structure, taken at plane 3-3 of FIG. 1, according to an aspect of the present disclosure.

FIG. 3 depicts an aft forward-looking view of the dome 56, taken at plane 3-3 (FIG. 1, according to an aspect of the present disclosure. As shown in FIG. 3, the dome 56 extends circumferentially about the combustor axial centerline 112. The dome 56 may be comprised of a plurality of dome-deflector structures 57 that each may be referred to as a dome segment that are connected together to define a continuous circumferential dome 56. For example, the dome 56 may include a first dome-deflector segment 95, a second dome-deflector segment 96, a third dome-deflector segment 97, etc., that define the circumferential dome 56. Each respective dome-deflector segment includes the dome-deflector structure 57, which includes a dome-deflector swirler opening 94 therethrough, where the swirler assembly 58 (FIG. 2) extends through the dome-deflector swirler opening 94.

Figure 4:
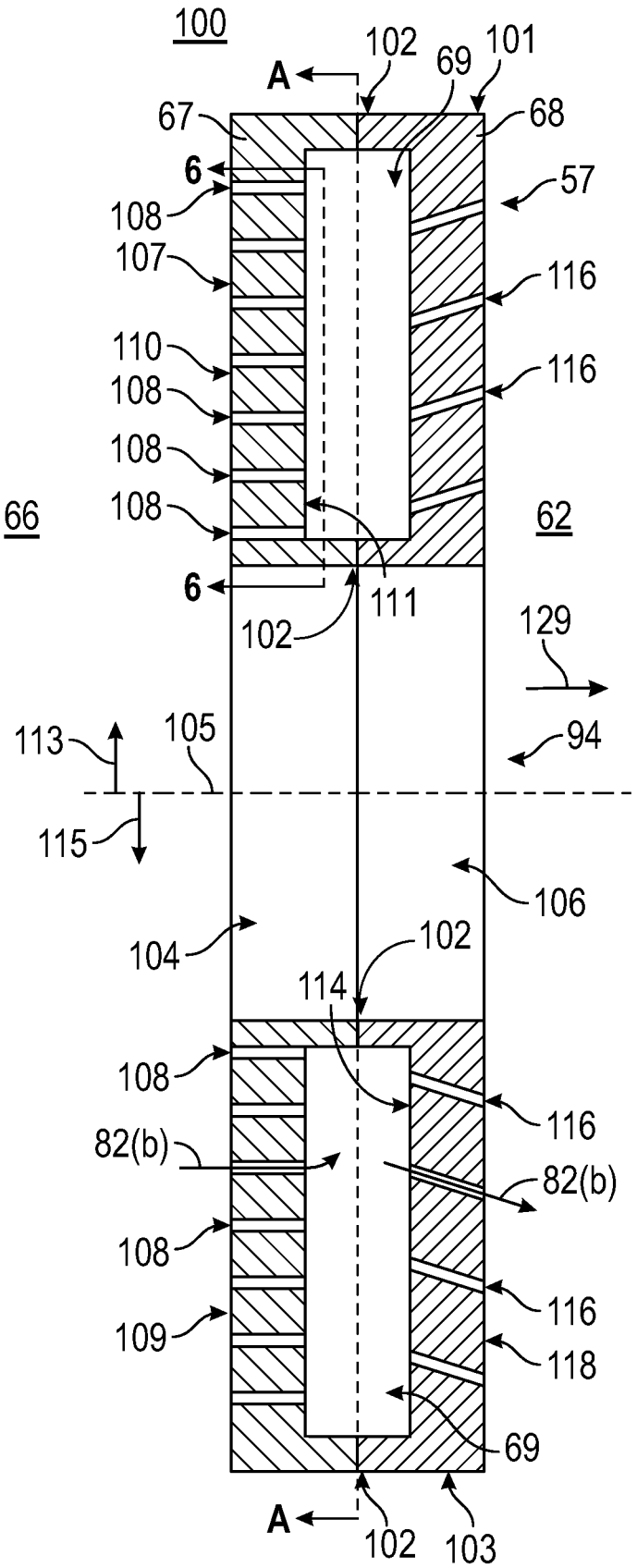
FIG. 4 depicts an enlarged view of a dome-deflector, taken at detail view 100 of FIG. 2, according to an aspect of the present disclosure.

FIG. 4 depicts an enlarged cross-sectional view of a dome-deflector structure 57, taken at detail view 100 of FIG. 2, according to an aspect of the present disclosure. In FIG. 4, connections between the dome-deflector structure 57 and the combustor 26 have been omitted, and the swirler assembly 58 has also been omitted. The dome portion 67 includes a dome-side swirler opening 104 therethrough that defines a swirler opening centerline axis 105, and the deflector portion 68 includes a deflector-side swirler opening 106 therethrough. The dome-deflector structure 57 includes the dome portion 67 and the deflector portion 68 that are connected together at a connection 102 at a radially outer side 101 of the dome portion 67 and the deflector portion 68, at a radially inner side 103 of the dome portion 67 and the deflector portion 68, and at the dome-side swirler opening 104 and the deflector-side swirler opening 106. A dome-deflector cavity 69 is thereby defined between the dome portion 67 and the deflector portion 68. The dome portion 67 may be considered to include an outer dome portion 107 on a first side 113 of the swirler opening centerline axis 105, and an inner dome portion 109 on a second side 115 of the swirler opening centerline axis 105. The dome portion 67 includes a plurality of dome-side cooling airflow passages 108 that extend therethrough from a cold side 110 of the dome portion 67 to a cavity side 111 of the dome portion 67. Various arrangements of the dome-side cooling airflow passages 108 will be described in more detail below. Briefly, however, the plurality of dome-side cooling airflow passages 108 are arranged with different circumferential angles through the dome portion 67 so as to provide a flow of the compressed air 82(*b*) into the dome-deflector cavity 69 in different swirl directions. Each of the dome-side cooling airflow passages 108 provide a flow of the compressed air 82(*b*) therethrough from the pressure plenum 66 o the dome-deflector cavity 69. The compressed air 82(*b*) in the dome-deflector cavity 69 provides impingement cooling to a cavity side 114 of the deflector portion 68. The deflector portion 68 may include a plurality of deflector cooling passages 116 that allow for a flow of the compressed air 82(*b*) from the dome-deflector cavity 69 to flow therethrough and provide film cooling to a hot side 118 of the deflector portion 68 adjacent to the combustion chamber 62.

Figure 5:
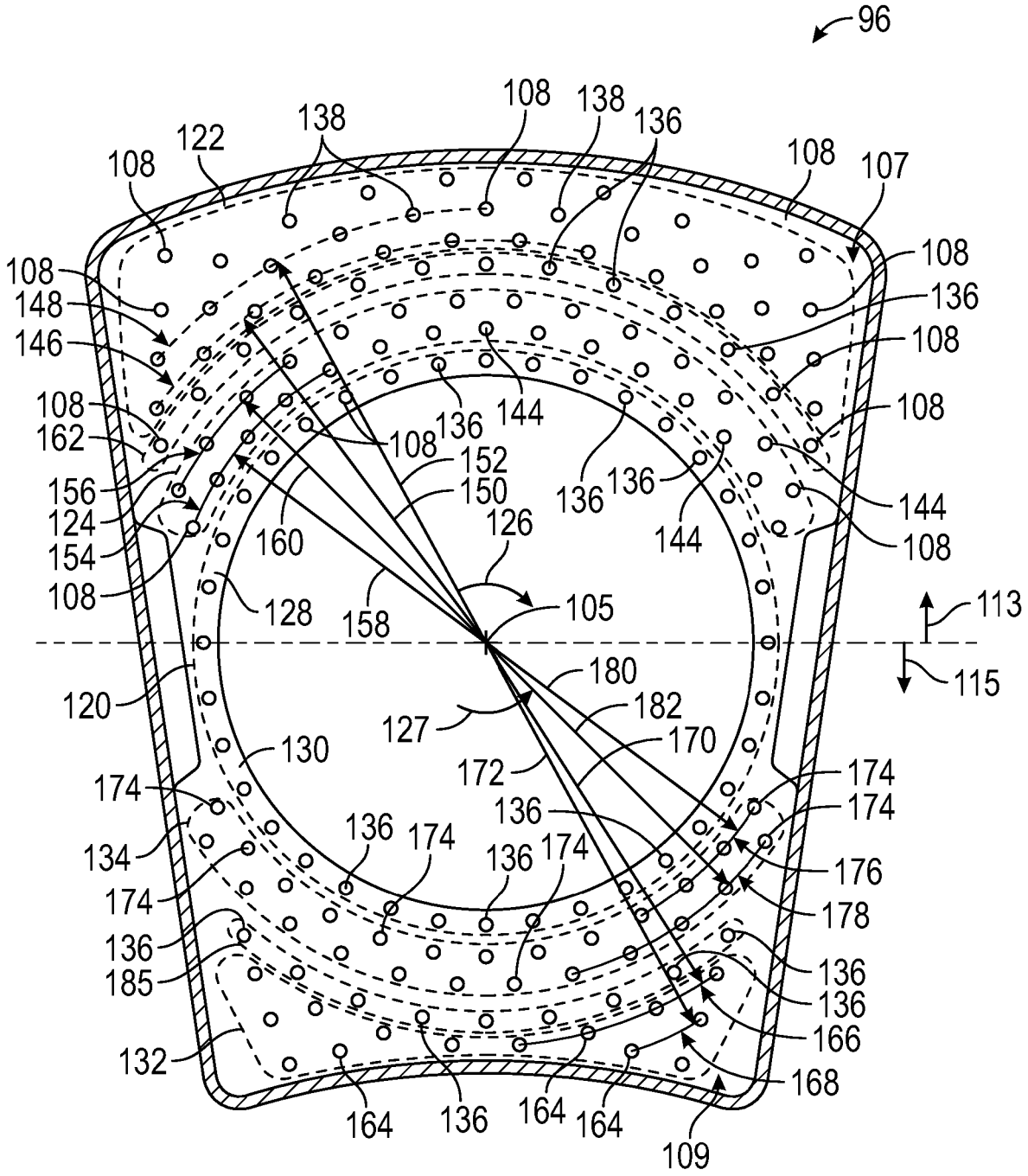
FIG. 5 is a cross-sectional view of a dome portion of the dome-deflector taken at plane A-A of FIG. 4, according to an aspect of the present disclosure.

FIG. 5 is a cross-sectional view of the dome portion 67 taken at plane A-A of FIG. 4, according to an aspect of the present disclosure. In FIG. 5, various arrangements of groupings of the plurality of dome-side cooling airflow passages 108 will be described. In the FIG. 5 aspect, the plurality of dome-side cooling airflow passages 108 are arranged in a plurality of groups, where each group of the dome-side cooling airflow passages 108 is arranged to provide the flow of compressed air 82(*b*) therethrough in a respective group swirl direction (to be described below), and adjacent groups of the dome-side cooling airflow passages 108 are arranged to provide the flow of the compressed air 82(*b*) in a different group swirl direction with respect to one another. In the outer dome portion 107 of the dome portion 67, the plurality of groups of dome-side cooling airflow passages 108 include a first portion 128 on the first side 113 of a first group 120 of dome-side cooling airflow passages 108 arranged radially inward with respect the swirler opening centerline axis 105, a second group 122 of dome-side cooling airflow passages 108 arranged radially outward with respect to the swirler opening centerline axis 105, and a third group 124 of dome-side cooling airflow passages 108 arranged radially between the first group 120 and the second group 122. The first group 120 of dome-side cooling airflow passages 108 is arranged to provide the flow of compressed air 82(*b*) therethrough in a non-swirl direction 129 (FIG. 4) (i.e., parallel with the swirler opening centerline axis 105). As shown in FIG. 5, the first group 120 generally includes the plurality of dome-side cooling airflow passages 108 arranged circumferentially about the swirler opening centerline axis 105 and each dome-side cooling airflow passage 108 of the first group provides the flow of the compressed air 82(*b*) in a group swirl direction that may be an axial direction (i.e., the non-swirl direction 129 parallel with the swirler opening centerline axis 105). That is, while the axial direction does not induce a swirl into the flow of air 82(*b*), the axial direction may be considered as group swirl direction having a zero swirl angle. Thus, each of the dome-side cooling airflow passages 108 that provides the flow of the compressed air 82(*b*) in the non-swirl (axial) direction may be referred to as an axial-flow cooling passage 136.

Figure 6:
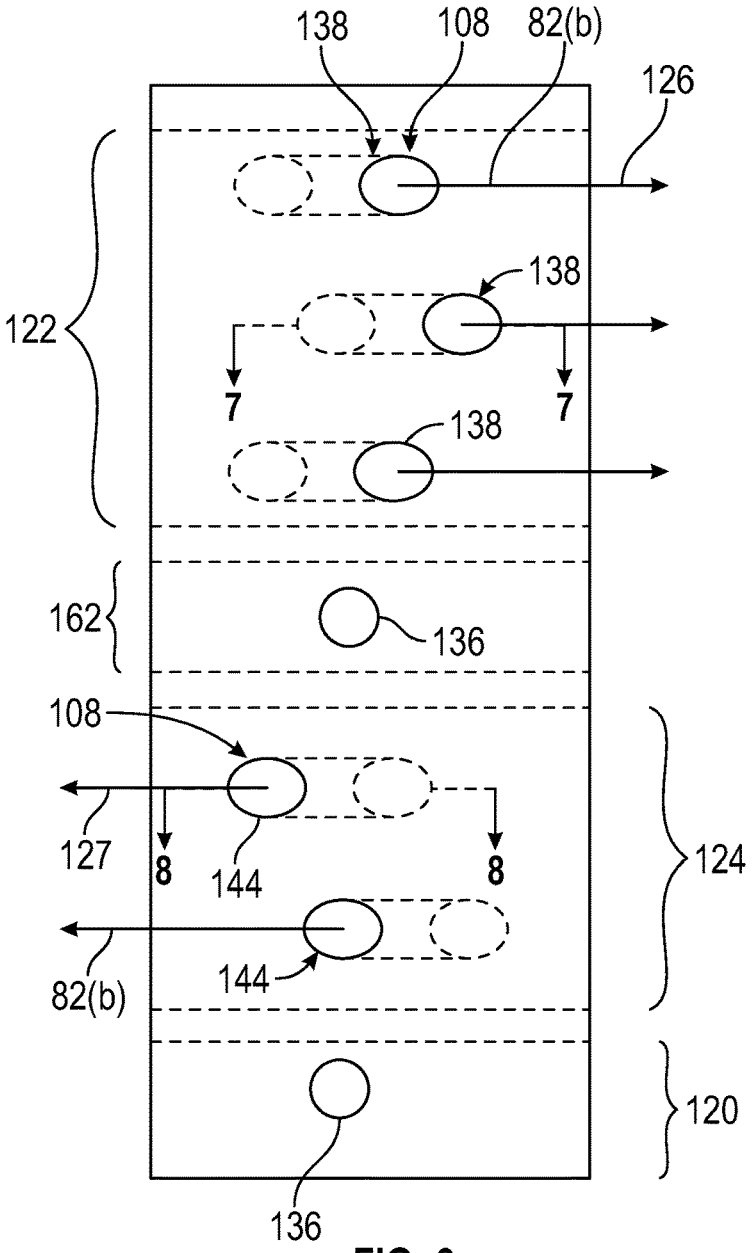
FIG. 6 is an aft-looking view taken at plane 6-6 of FIG. 4, according to an aspect of the present disclosure.

The second group 122 of dome-side cooling airflow passages 108 is arranged to provide the flow of compressed air 82(*b*) therethrough in a first swirl direction 126, which in FIG. 5, may be a clockwise direction. For example, referring to FIG. 6, which is a view taken at plane 6-6 of FIG. 4, and FIG. 7, which is a cross-sectional view taken at plane 7-7 of FIG. 6, the dome-side cooling airflow passages 108 in the second group 122 may be arranged through the dome portion 67 at a circumferential angle 140 so as to provide the flow of the compressed air 82(*b*) therethrough in the first swirl direction 126. Thus, each of the dome-side cooling airflow passages 108 in the second group 122 may be referred to as a second group dome-side cooling airflow passage 138.

As shown in FIG. 5, the second group 122 of dome-side cooling airflow passages 108 includes a plurality of rows of second group dome-side cooling airflow passages 138, including a first row 146 of second group dome-side cooling airflow passages 138, and a second row 148 of second group dome-side cooling airflow passages 138. Each row of the plurality of rows of the second group dome-side cooling airflow passages 138 is arranged in the circumferential direction and is arranged at a different radial distance from the swirler opening centerline axis 105. For example, the first row 146 of second group dome-side cooling airflow passages 138 is shown arranged at a first radial distance 150 with respect to the swirler opening centerline axis 105, and the second row 148 of second group dome-side cooling airflow passages 138 is shown arranged at a second radial distance 152 with respect to the swirler opening centerline axis 105.

Referring still to FIG. 5, the third group 124 of dome-side cooling airflow passages 108 is arranged to provide the flow of the compressed air 82(*b*) therethrough in a second swirl direction 127 opposite the first swirl direction 126. For example, referring again to FIG. 6, and to FIG. 8, which is a cross-sectional view taken at plane 8-8 of FIG. 6, the dome-side cooling airflow passages 108 in the third group 124 may be arranged through the dome portion 67 at a circumferential angle 142 so as to provide the flow of the compressed air 82(*b*) therethrough in the second swirl direction 127, which may be a counter-clockwise direction. Thus, each of the dome-side cooling airflow passages 108 in the third group 124 may be referred to as a third group dome-side cooling airflow passage 144.

In FIG. 5, the third group 124 of dome-side cooling airflow passages 108 includes a plurality of rows of third group dome-side cooling airflow passages 144, including a first row 154 of third group dome-side cooling airflow passages 144, and a second row 156 of third group dome-side cooling airflow passages 144. Each row of the plurality of rows of the third group dome-side cooling airflow passages 144 is arranged in the circumferential direction and is arranged at a different radial distance from the swirler opening centerline axis 105. For example, the first row 154 of third group dome-side cooling airflow passages 144 is shown arranged at a first radial distance 158 with respect to the swirler opening centerline axis 105, and the second row 156 of third group dome-side cooling airflow passages 144 is shown arranged at a second radial distance 160 with respect to the swirler opening centerline axis 105.

The outer dome portion 107 of the dome portion 67 may further include an outer intermediate group 162 of dome-side cooling airflow passages 108 arranged between the second group 122 of dome-side cooling airflow passages 108 and the third group 124 of dome-side cooling airflow passages 108. The outer intermediate group 162 of dome-side cooling airflow passages 108 is arranged to provide the flow of the compressed air 82(*b*) in the non-swirl direction 129 and thus, may constitute the axial-flow cooling passages 136. Thus, with the foregoing swirl direction arrangements for the dome-side cooling airflow passages 108 in the first group, the third group, the intermediate group, and the second group, respectively, in an outward radial direction from the swirler opening centerline axis 105, an alternating swirled flow from an axial flow (first group 120), to a counter-clockwise flow (third group 124), to an axial flow (outer intermediate group 162), to a clockwise flow (second group 122) can be achieved within the dome-deflector cavity 69. As a result, a better impingement cooling of the cavity side 114 of the deflector portion 68 can be achieved. Additionally, dust and/or dirt build-up that may occur with a continuous bulk swirl flow can be reduced.

The inner dome portion 109 of FIG. 5 includes a similar arrangement of groups as that of the outer dome portion 107. The inner dome portion 109 includes a second portion 130 of the first group 120 of the plurality of dome-side cooling airflow passages 108, a fourth group 132 of the dome-side cooling airflow passages 108, and a fifth group 134 of the dome-side cooling airflow passages 108. The second portion 130 of the first group 120 of the dome-side cooling airflow passages 108 may include the axial-flow cooling passages 136. The fourth group 132 includes a plurality of rows of fourth group dome-side cooling airflow passages 164, including a first row 166 of fourth group dome-side cooling airflow passages 164 arranged at a first radial distance 170 with respect to the swirler opening centerline axis 105, and a second row 168 of fourth group dome-side cooling airflow passages 164 arranged at a second radial distance 172 with respect to the swirler opening centerline axis 105. In the aspect of FIG. 5, the fourth group dome-side cooling airflow passages 164 may be the same as the third group dome-side cooling airflow passages 144 so as to provide the flow of the compressed air 82(*b*) therethrough in the second swirl direction 127.

The fifth group 134 includes a plurality of fifth group dome-side cooling airflow passages 174 that may be arranged in a plurality of rows, including a first row 176 of fifth group dome-side cooling airflow passages 174 arranged at a first radial distance 180 with respect to the swirler opening centerline axis 105, and a second row 178 of fifth group dome-side cooling airflow passages 174 arranged at a second radial distance 182 with respect to the swirler opening centerline axis 105. The fifth group dome-side cooling airflow passages 174 may be similar to the second group dome-side cooling airflow passages 138 so as to provide a flow of the compressed air 82(*b*) in the first swirl direction 126 within the dome-deflector cavity 69. In the same manner as with the outer dome portion 107, the inner dome portion 109 may include an inner intermediate group 185 of the axial-flow cooling passages 136 provided between the fourth group 132 and the fifth group 134.

Figure 7:
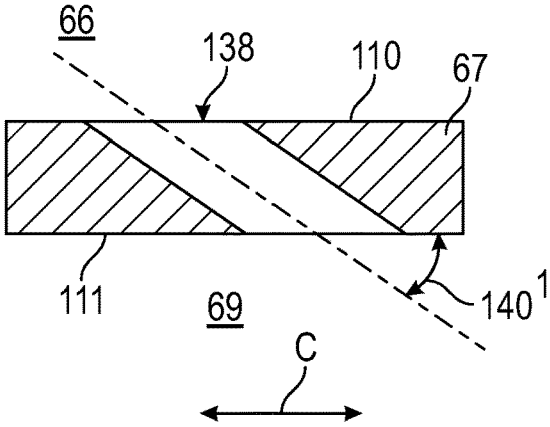
FIG. 7 is a cross-sectional view taken at plane 7-7 of FIG. 6, according to an aspect of the present disclosure.
Figure 8:
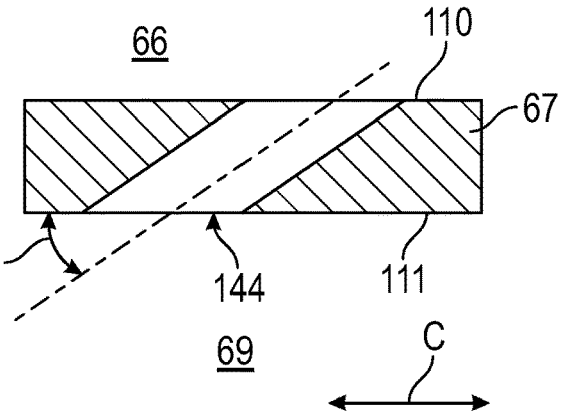
FIG. 8 is a cross-sectional view taken at plane 8-8 of FIG. 6, according to an aspect of the present disclosure.
Figure 9:
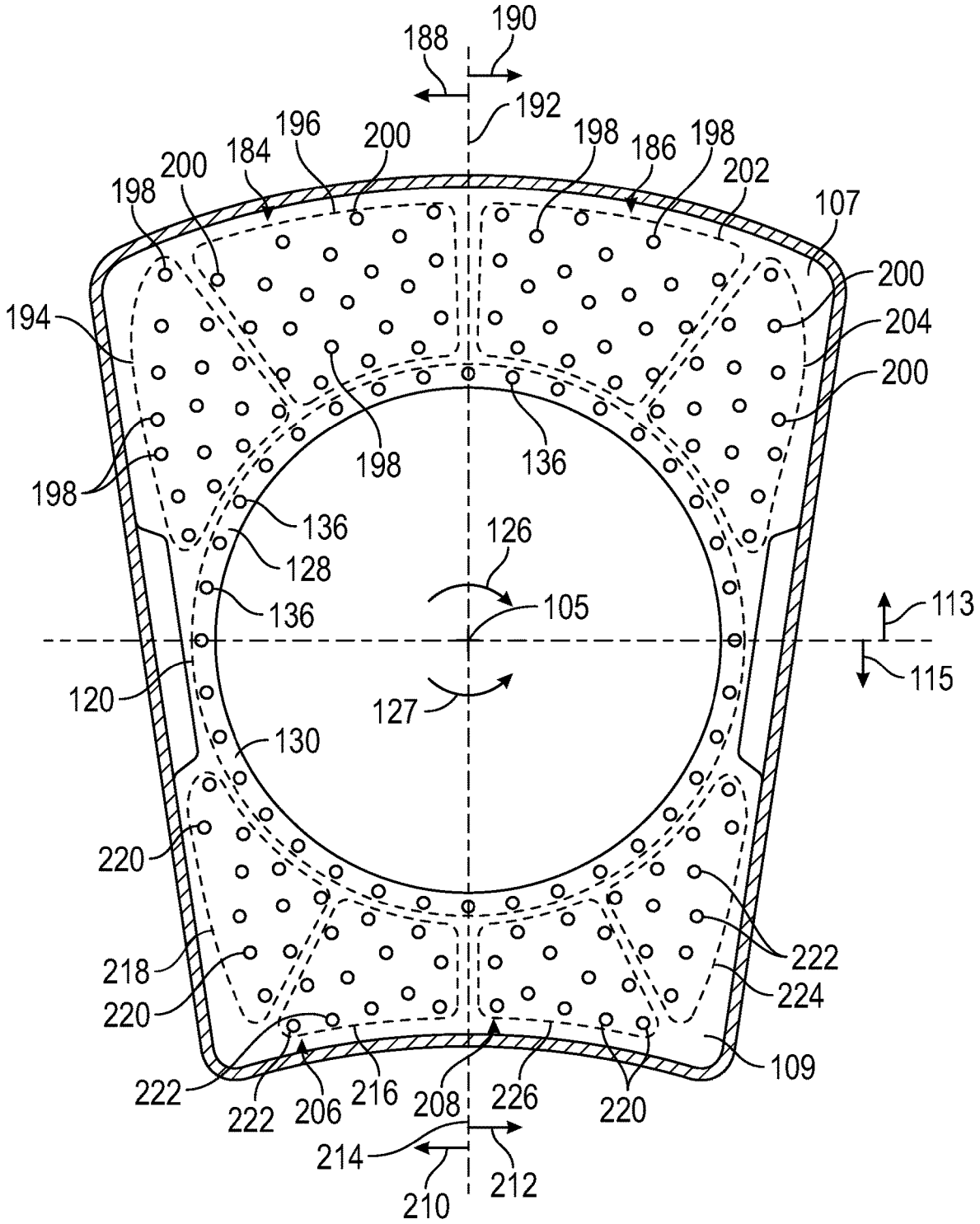
FIG. 9 is a cross-sectional view of an alternate arrangement of the dome portion of the dome-deflector, according to another aspect of the present disclosure.

FIG. 9 is a cross-sectional view of an alternate arrangement of the dome portion 67, according to another aspect of the present disclosure. In FIG. 9, various alternate arrangements of groupings of the plurality of dome-side cooling airflow passages 108 will be described. In the FIG. 9 aspect, similar to the FIG. 5 aspect, the dome portion 67 also includes the outer dome portion 107 and the inner dome portion 109. In the FIG. 9 aspect, however, the outer dome portion 107 includes a first outer portion 184 defined on a first side 188 of an outer portion radial line 192 extending radially outward from the swirler opening centerline axis 105, and a second outer portion 186 defined on a second side 190 of the outer portion radial line 192. The first outer portion 184 includes a plurality of first outer portion groups of the outer portion dome-side cooling airflow passages, including a first group 194 of first outer portion dome-side cooling airflow passages 198, and a second group 196 of the second outer portion dome-side cooling airflow passages 200. The first outer portion dome-side cooling airflow passages 198 in the first group 194 may be arranged at the circumferential angle 140 similar to the second group dome-side cooling airflow passages 138 (FIG. 7) to provide the flow of compressed air 82(*b*) in the first swirl direction 126, and the second outer portion dome-side cooling airflow passages 200 in the second group 196 may be arranged at the circumferential angle 142 similar to the third group dome-side cooling airflow passages 144 (FIG. 8) so as to provide the flow of compressed air 82(*b*) in the second swirl direction 127.

Similar to the first outer portion 184, the second outer portion 186 includes a plurality of second outer portion groups of the outer portion dome-side cooling airflow passages, including a first group 202 of the first outer portion dome-side cooling airflow passages 198 and a second group 204 of the second outer portion dome-side cooling airflow passages 200. The first group 202 of the first outer portion dome-side cooling airflow passages 198 may be arranged at the circumferential angle 140 (FIG. 7) to provide the flow of compressed air 82(*b*) in the first swirl direction 126, and the second group 204 of the second outer portion dome-side cooling airflow passages 200 may be arranged at the circumferential angle 142 to provide the flow of the compressed air 82(*b*) in the second swirl direction 127 opposite the first swirl direction 126. In this manner, the second outer portion dome-side cooling airflow passages 198 of the first group 202 may be similar to the second group dome-side cooling airflow passages 138 (FIG. 7), and the second outer portion dome-side cooling airflow passages 200 of the second group 204 may be similar to the third group dome-side cooling airflow passages 144 (FIG. 8).

Referring still to FIG. 9, the inner dome portion 109 includes a first inner portion 206 defined on a first side 210 of an inner portion radial line 214 extending radially inward from the swirler opening centerline axis 105, and a second inner portion 208 on a second side 212 of the inner portion radial line 214. The first inner portion 206 includes a plurality of first inner portion groups of first inner portion dome-side cooling airflow passages, including a first group 216 of first inner portion dome-side cooling airflow passages 222, and a second group 218 of first inner portion dome-side cooling airflow passages 220. The first group 216 of first inner portion dome-side cooling airflow passages 222 may be arranged at the circumferential angle 140 (FIG. 7) to provide the flow of the compressed air 82(*b*) in the first swirl direction 126, and the second group 218 of the first inner portion dome-side cooling airflow passages 220 may be arranged at the circumferential angle 142 (FIG. 8) to provide the flow of the compressed air 82(*b*) in the second swirl direction 127 opposite the first swirl direction 126.

Similarly, the second inner portion 208 includes a plurality of second inner portion groups of dome-side cooling airflow passages, including a first group 224 of the second inner portion dome-side cooling airflow passages 222, and a second group 226 of the second inner portion dome-side cooling airflow passages 220. The first group 224 of the second inner portion dome-side cooling airflow passages 222 may be arranged at the circumferential angle 140 (FIG. 7) to provide the flow of the compressed air 82(*b*) in the first swirl direction 126, and the second group 226 of the second inner portion dome-side cooling airflow passages 220 may be arranged at the circumferential angle 142 (FIG. 8) to provide the flow of the compressed air 82(*b*) in the second swirl direction 127 opposite the first swirl direction 126. Thus, the second inner portion dome-side cooling airflow passages 220 of the first group 224 may be arranged similar to the third group dome-side cooling airflow passages 144 (FIG. 8), and the second inner portion dome-side cooling airflow passages 220 of the second group 226 may be arranged similar to the second group dome-side cooling airflow passages 138 (FIG. 7).

While the foregoing description relates generally to a gas turbine engine, it can readily be understood that the gas turbine engine may be implemented in various environments. For example, the engine may be implemented in an aircraft, but may also be implemented in non-aircraft applications, such as power generating stations, marine applications, or oil and gas production applications. Thus, the present disclosure is not limited to use in aircraft.

Thus, the present disclosure provides a dome structure having cooling passages arranged in the dome to provide improved circulation of the airflow within the dome-deflector cavity. Each group of dome-side cooling airflow passages is arranged to provide a flow of air therethrough in a respective group swirl direction, and adjacent groups of the dome-side cooling airflow passages provide the flow of air in a different group swirl direction with respect to one another. Thus, the arrangement of the cooling airflow passages through the dome can provide for opposing flows of the air into the cavity in different swirl directions, thereby reducing the impact that the bulk swirl arrangement has on reducing the feed pressure to the airflow passages through the deflector. In addition, the arrangement of the cooling passages through the dome generates greater mixing and turbulence of the airflow within the dome-deflector cavity to reduce dust and dirt build-up that may otherwise occur.

Further aspects of the present disclosure are provided by the subject matter of the following clauses.

A dome-deflector structure for a combustor of a gas turbine, the dome-deflector structure including a dome portion having a dome-side swirler opening therethrough, and a deflector portion having a deflector-side swirler opening therethrough, the dome portion and the deflector portion being connected together to form a dome-deflector cavity therebetween, wherein the dome portion includes a plurality of dome-side cooling airflow passages therethrough arranged in a plurality of groups of dome-side cooling airflow passages, each group of dome-side cooling airflow passages being arranged to provide a flow of air therethrough in a respective group swirl direction, and adjacent groups of the dome-side cooling airflow passages providing the flow of air in a different group swirl direction with respect to one another.

The dome-deflector structure according to the preceding clause, wherein the dome-side swirler opening defines a swirler opening centerline axis therethrough, an axial direction extending along the swirler opening centerline axis, a radial direction extending outward from the swirler opening centerline axis, and a circumferential direction extending about the swirler opening centerline axis.

The dome-deflector structure according to any preceding clause, wherein the plurality of groups of dome-side cooling airflow passages include a first group of dome-side cooling airflow passages arranged radially inward with respect the swirler opening centerline axis, a second group of dome-side cooling airflow passages arranged radially outward with respect to the swirler opening centerline axis, and a third group of dome-side cooling airflow passages arranged radially between the first group of dome-side cooling airflow passages and the second group of dome-side cooling airflow passages.

The dome-deflector structure according to any preceding clause, wherein the first group of dome-side cooling airflow passages is arranged to provide the flow of air therethrough in a non-swirl direction, the second group of dome-side cooling airflow passages is arranged to provide the flow of air therethrough in a first swirl direction, and the third group of dome-side cooling airflow passages is arranged to provide the flow of air therethrough in a second swirl direction opposite the first swirl direction.

The dome-deflector structure according to any preceding clause, further comprising an intermediate group of dome-side cooling airflow passages arranged between the second group of dome-side cooling airflow passages and the third group of dome-side cooling airflow passages, the intermediate group of dome-side cooling airflow passages being arranged to provide the flow of air in the non-swirl direction.

The dome-deflector structure according to any preceding clause, wherein the dome portion includes an outer dome portion and an inner dome portion, the outer dome portion including a first portion of the first group of dome-side cooling airflow passages, the second group of dome-side cooling airflow passages, and the third group of dome-side cooling airflow passages, and the inner dome portion including a second portion of the first group of dome-side cooling airflow passages, a fourth group of dome-side cooling airflow passages arranged radially outward with respect to the swirler opening centerline axis, and a fifth group of dome-side cooling airflow passages arranged between the second portion of the first group of dome-side cooling airflow passages and the fourth group of dome-side cooling airflow passages.

The dome-deflector structure according to any preceding clause, wherein the fourth group of dome-side cooling airflow passages are arranged to provide the flow of air therethrough in the second swirl direction, and the fifth group of dome-side cooling airflow passages are arranged to provide the flow of air therethrough in the first swirl direction.

The dome-deflector structure according any preceding clause, wherein the second group of dome-side cooling airflow passages includes a plurality of rows of second group dome-side cooling airflow passages, and the third group of dome-side cooling airflow passages includes a plurality of rows of third group dome-side cooling airflow passages.

The dome-deflector structure according to any preceding clause, wherein each row of the plurality of rows of the second group of dome-side cooling airflow passages is arranged in the circumferential direction and is arranged at a different radial distance from the swirler opening centerline axis, and each row of the plurality of rows of the third group of dome-side cooling airflow passages is arranged in the circumferential direction and at a different radial distance from the swirler opening centerline axis.

The dome-deflector structure according to any preceding clause, wherein the dome portion includes an outer dome portion on an outer side of the swirler opening centerline axis, and an inner dome portion on an inner side of the swirler opening centerline axis, the outer dome portion includes a first outer dome portion defined on a first side of an outer dome portion radial line extending radially outward from the swirler opening centerline axis, and a second outer dome portion defined on a second side of the outer dome portion radial line, the first outer dome portion including a plurality of first outer dome portion groups of the dome-side cooling airflow passages, and the second outer dome portion including a plurality of second outer dome portion groups of the dome-side cooling airflow passages.

The dome-deflector structure according to any preceding clause, wherein the plurality of first outer dome portion groups of the dome-side cooling airflow passages includes a first group of first outer portion dome-side cooling airflow passages and a second group of second outer portion dome-side cooling airflow passages, the first group of first outer portion dome-side cooling airflow passages being arranged to provide the flow of air in a first swirl direction and the second group of second outer portion dome-side cooling airflow passages being arranged to provide the flow of air in a second swirl direction opposite the first swirl direction.

The dome-deflector structure according to any preceding clause, wherein the plurality of second outer dome portion groups of the dome-side cooling airflow passages includes a first group of the first outer portion dome-side cooling airflow passages and a second group of the second outer portion dome-side cooling airflow passages, the first group of the first outer portion dome-side cooling airflow passages being arranged to provide the flow of air in the first swirl direction and the second group of the second outer portion dome-side cooling airflow passages being arranged to provide the flow of air in the second swirl direction opposite the first swirl direction.

The dome-deflector structure according to any preceding clause, wherein the inner dome portion includes a first inner portion defined on a first side of an inner portion radial line extending radially inward from the swirler opening centerline axis, and a second inner portion on a second side of the inner portion radial line, the first inner portion including a plurality of first inner portion groups of the dome-side cooling airflow passages, and the second inner portion including a plurality of second inner portion groups of the dome-side cooling airflow passages.

The dome-deflector structure according to any preceding clause, wherein the plurality of first inner portion groups of the dome-side cooling airflow passages includes a first group of first inner portion dome-side cooling airflow passages and a second group of second inner portion dome-side cooling airflow passages, the first group of first inner portion dome-side cooling airflow passages being arranged to provide the flow of air in the first swirl direction and the second group of second inner portion dome-side cooling airflow passages being arranged to provide the flow of air in the second swirl direction opposite the first swirl direction.

The dome-deflector structure according to any preceding clause, wherein the plurality of second inner portion groups of the dome-side cooling airflow passages includes a first group of the first inner portion dome-side cooling airflow passages and a second group of the second inner portion dome-side cooling airflow passages, the first group of first inner portion dome-side cooling airflow passages being arranged to provide the flow of air in the first swirl direction and the second group of the second inner portion dome-side cooling airflow passages being arranged to provide the flow of air in the second swirl direction opposite the first swirl direction.

The dome-deflector structure according to any preceding clause, wherein each respective dome-side cooling airflow passage is arranged through the dome portion from a cold side of the dome portion to a cavity side of the dome portion at a respective cooling passage angle.

The dome-deflector structure according to any preceding clause, wherein each dome-side cooling airflow passage in the first group of dome-side cooling airflow passages includes a cooling passage angle that is parallel with the axial direction, each dome-side cooling airflow passage in the second group of dome-side cooling airflow passages includes a cooling passage angle in a first circumferential direction, each dome-side cooling airflow passage in the third group of dome-side cooling airflow passages includes a cooling passage angle in a second circumferential direction, each dome-side cooling airflow passage in the fourth group of dome-side cooling airflow passages includes a cooling passage angle in the second circumferential direction, and each dome-side cooling airflow passage in the fifth group of dome-side cooling airflow passages includes a cooling passage angle in the first circumferential direction.

The dome-deflector structure according to any preceding clause, wherein the first circumferential direction is a clockwise direction about the swirler opening centerline axis, and the second swirl direction is a counter-clockwise direction about the swirler opening centerline axis.

The dome-deflector structure according to any preceding clause, wherein each respective dome-side cooling airflow passage is arranged through the dome portion from a cold side of the dome portion to a cavity side of the dome portion at a respective cooling passage angle.

The dome-deflector structure according to any preceding clause, wherein each dome-side cooling airflow passage in the first group of dome-side cooling airflow passages includes a cooling passage angle that is parallel with the axial direction, each dome-side cooling airflow passage in the first group of first outer portion dome-side cooling airflow passages includes a cooling passage angle in a first circumferential direction, each dome-side cooling airflow passage in the second group of second outer portion dome-side cooling airflow passages includes a cooling passage angle in a second circumferential direction, each dome-side cooling airflow passage in the first group of the first outer portion dome-side cooling airflow passages includes a cooling passage angle in the first circumferential direction, and each dome-side cooling airflow passage in the second group of the second outer portion dome-side cooling airflow passages includes a cooling passage angle in the second circumferential direction.

Although the foregoing description is directed to some exemplary embodiments of the present disclosure, other variations and modifications will be apparent to those skilled in the art, and may be made without departing from the spirit or the scope of the disclosure. Moreover, features described in connection with one embodiment of the present disclosure may be used in conjunction with other embodiments, even if not explicitly stated above.

We claim:

1. A dome-deflector structure for a combustor of a gas turbine, the dome-deflector structure comprising:

a dome portion having a dome-side swirler opening therethrough; and a deflector portion having a deflector-side swirler opening therethrough, the dome portion and the deflector portion being connected together to form a dome-deflector cavity therebetween, wherein the dome portion includes a plurality of dome-side cooling airflow passages therethrough arranged in a plurality of groups of dome-side cooling airflow passages including a first group of dome-side cooling airflow passages arranged to provide a flow of air therethrough in a first swirl direction, a second group of dome-side cooling airflow passages arranged to provide a flow of air therethrough in a second swirl direction different from the first swirl direction, and a third group of dome-side cooling airflow passages arranged to provide a flow of air therethrough in a third swirl direction opposite the second swirl direction.

2. The dome-deflector structure according to claim 1, wherein the dome-side swirler opening defines a swirler opening centerline axis therethrough, an axial direction extending along the swirler opening centerline axis, a radial direction extending outward from the swirler opening centerline axis, and a circumferential direction extending about the swirler opening centerline axis.

3. The dome-deflector structure according to claim 2, wherein the first group of dome-side cooling airflow passages is arranged radially inward with respect to the swirler opening centerline axis, the second group of dome-side cooling airflow passages is arranged radially outward with respect to the swirler opening centerline axis, and the third group of dome-side cooling airflow passages is arranged radially between the first group of dome-side cooling airflow passages and the second group of dome-side cooling airflow passages.

4. The dome-deflector structure according to claim 3, wherein the first swirl directions is a non-swirl direction, the second swirl direction is at least partially in a first circumferential direction, and the third swirl direction is at least partially in a second circumferential direction opposite the first circumferential direction.

5. The dome-deflector structure according to claim 4, further comprising an intermediate group of dome-side cooling airflow passages arranged between the second group of dome-side cooling airflow passages and the third group of dome-side cooling airflow passages, the intermediate group of dome-side cooling airflow passages being arranged to provide the flow of air in the non-swirl direction.

6. The dome-deflector structure according to claim 4, wherein the dome portion includes an outer dome portion and an inner dome portion, the outer dome portion including a first portion of the first group of dome-side cooling airflow passages, the second group of dome-side cooling airflow passages, and the third group of dome-side cooling airflow passages, and the inner dome portion including a second portion of the first group of dome-side cooling airflow passages, a fourth group of dome-side cooling airflow passages arranged radially outward with respect to the swirler opening centerline axis, and a fifth group of dome-side cooling airflow passages arranged between the second portion of the first group of dome-side cooling airflow passages and the fourth group of dome-side cooling airflow passages.

7. The dome-deflector structure according to claim 6, wherein the fourth group of dome-side cooling airflow passages are arranged to provide the flow of air therethrough in the third swirl direction, and the fifth group of dome-side cooling airflow passages are arranged to provide the flow of air therethrough in the second swirl direction.

8. The dome-deflector structure according to claim 3, wherein the second group of dome-side cooling airflow passages includes a plurality of rows of second group dome-side cooling airflow passages, and the third group of dome-side cooling airflow passages includes a plurality of rows of third group dome-side cooling airflow passages.

9. The dome-deflector structure according to claim 8, wherein each row of the plurality of rows of the second group of dome-side cooling airflow passages is arranged in the circumferential direction and is arranged at a different radial distance from the swirler opening centerline axis, and each row of the plurality of rows of the third group of dome-side cooling airflow passages is arranged in the circumferential direction and at a different radial distance from the swirler opening centerline axis.

10. The dome-deflector structure according to claim 2, wherein the dome portion includes an outer dome portion on an outer side of the swirler opening centerline axis, and an inner dome portion on an inner side of the swirler opening centerline axis, the outer dome portion includes a first outer dome portion defined on a first side of an outer dome portion radial line extending radially outward from the swirler opening centerline axis, and a second outer dome portion defined on a second side of the outer dome portion radial line, the first outer dome portion including a plurality of first outer dome portion groups of the dome-side cooling airflow passages, and the second outer dome portion including a plurality of second outer dome portion groups of the dome-side cooling airflow passages.

11. The dome-deflector structure according to claim 10, wherein the plurality of first outer dome portion groups of the dome-side cooling airflow passages includes a first group of first outer portion dome-side cooling airflow passages and a second group of second outer portion dome-side cooling airflow passages, the first group of first outer portion dome-side cooling airflow passages being arranged to provide the flow of air in the second swirl direction and the second group of second outer portion dome-side cooling airflow passages being arranged to provide the flow of air in the third swirl direction opposite the second swirl direction.

12. The dome-deflector structure according to claim 11, wherein the plurality of second outer dome portion groups of the dome-side cooling airflow passages includes a first group of the first outer portion dome-side cooling airflow passages and a second group of the second outer portion dome-side cooling airflow passages, the first group of the first outer portion dome-side cooling airflow passages being arranged to provide the flow of air in the second swirl direction and the second group of the second outer portion dome-side cooling airflow passages being arranged to provide the flow of air in the third swirl direction opposite the second swirl direction.

13. The dome-deflector structure according to claim 12, wherein the inner dome portion includes a first inner portion defined on a first side of an inner portion radial line extending radially inward from the swirler opening centerline axis, and a second inner portion on a second side of the inner portion radial line, the first inner portion including a plurality of first inner portion groups of the dome-side cooling airflow passages, and the second inner portion including a plurality of second inner portion groups of the dome-side cooling airflow passages.

14. The dome-deflector structure according to claim 13, wherein the plurality of first inner portion groups of the dome-side cooling airflow passages includes a first group of first inner portion dome-side cooling airflow passages and a second group of second inner portion dome-side cooling airflow passages, the first group of first inner portion dome-side cooling airflow passages being arranged to provide the flow of air in the second swirl direction and the second group of second inner portion dome-side cooling airflow passages being arranged to provide the flow of air in the third swirl direction opposite the second swirl direction.

15. The dome-deflector structure according to claim 14, wherein the plurality of second inner portion groups of the dome-side cooling airflow passages includes a first group of the first inner portion dome-side cooling airflow passages and a second group of the second inner portion dome-side cooling airflow passages, the first group of first inner portion dome-side cooling airflow passages being arranged to provide the flow of air in the second swirl direction and the second group of the second inner portion dome-side cooling airflow passages being arranged to provide the flow of air in the third swirl direction opposite the second swirl direction.

16. The dome-deflector structure according to claim 7, wherein each respective dome-side cooling airflow passage is arranged through the dome portion from a cold side of the dome portion to a cavity side of the dome portion at a respective cooling passage angle.

17. The dome-deflector structure according to claim 16, wherein each dome-side cooling airflow passage in the first group of dome-side cooling airflow passages includes a cooling passage angle that is parallel with the axial direction, each dome-side cooling airflow passage in the second group of dome-side cooling airflow passages includes a cooling passage angle in a first circumferential direction, each dome-side cooling airflow passage in the third group of dome-side cooling airflow passages includes a cooling passage angle in a second circumferential direction, each dome-side cooling airflow passage in the fourth group of dome-side cooling airflow passages includes a cooling passage angle in the second circumferential direction, and each dome-side cooling airflow passage in the fifth group of dome-side cooling airflow passages includes a cooling passage angle in the first circumferential direction.

18. The dome-deflector structure according to claim 17, wherein the first circumferential direction is a clockwise direction about the swirler opening centerline axis, and the second circumferential direction is a counter-clockwise direction about the swirler opening centerline axis.

19. The dome-deflector structure according to claim 12, wherein each respective dome-side cooling airflow passage is arranged through the dome portion from a cold side of the dome portion to a cavity side of the dome portion at a respective cooling passage angle.

20. The dome-deflector structure according to claim 19, wherein each dome-side cooling airflow passage in the first group of dome-side cooling airflow passages includes a cooling passage angle that is parallel with the axial direction, each dome-side cooling airflow passage in the first group of first outer portion dome-side cooling airflow passages includes a cooling passage angle in a first circumferential direction, each dome-side cooling airflow passage in the second group of second outer portion dome-side cooling airflow passages includes a cooling passage angle in a second circumferential direction, each dome-side cooling airflow passage in the first group of the first outer portion dome-side cooling airflow passages includes a cooling passage angle in the first circumferential direction, and each dome-side cooling airflow passage in the second group of the second outer portion dome-side cooling airflow passages includes a cooling passage angle in the second circumferential direction.

* * * * *